United States Patent [19]

Letteri, Jr.

[11] Patent Number: 4,997,093

[45] Date of Patent: Mar. 5, 1991

[54] ITEM DRYING DEVICE

[76] Inventor: Vincent E. Letteri, Jr., 8 Sunset Ave., Montrose, N.Y. 10548

[21] Appl. No.: 362,808

[22] Filed: Jun. 7, 1989

[51] Int. Cl.[5] ..... A47F 5/00

[52] U.S. Cl. ..... 211/86

[58] Field of Search ..... 211/86, 90, 34

[56] References Cited

U.S. PATENT DOCUMENTS

| | | | |
|---|---|---|---|
| 1,683,526 | 9/1928 | Campbell | 211/86 |
| 1,903,262 | 3/1933 | Goings | 211/86 X |
| 2,087,757 | 7/1937 | Foss | 211/86 |
| 2,151,510 | 3/1939 | Gorfein | 211/86 |
| 3,037,639 | 6/1962 | Kost | 211/86 X |
| 3,400,829 | 9/1968 | Yourgson | 211/86 |
| 3,833,127 | 9/1974 | Schoen et al. | 211/86 |
| 4,637,517 | 1/1987 | Barbosa et al. | 211/86 |
| 4,901,871 | 2/1990 | Ohm et al. | 211/86 |

*Primary Examiner*—Robert W. Gibson, Jr.
*Attorney, Agent, or Firm*—CTC & Associates

[57] ABSTRACT

A drying device for use with a baseboard heater includes an upper member of heat resistant plastic or metal with an open rack portion on which items are placeable for drying, a heater engaging portion for interlocking engagement with the top of the heater. The device also includes a substructure witha plurality of legs spaced from the heater engaging portion and from each other for supporting the upper member while engaging a floor. The legs are of adjustable length so the rack portion can be set horizontally regardless of the height of the top of the heater above the floor. A drip tray is releasably held under the rack portion. The upper member also has a downwardly sloping closed portion between the rack portion and the heater engaging portion for directing hot air from the heater to the rack portion.

10 Claims, 3 Drawing Sheets

ITEM DRYING DEVICE

BACKGROUND OF THE INVENTION

This invention relates to an item drying device, and more particularly to a drying device for gloves, shoes, boots and other articles of clothing that have become wet with rain or melting snow. Still more particularly, the device makes use of heat from a baseboard heater.

The inventive drying device is of simple, economical construction. The device is connected to a baseboard heater and efficiently utilizes heat from the baseboard heater to dry items placed on the device.

The inventive drying device readily accommodates itself for use with baseboard heaters having tops which are at varying heights above the floor.

Important objects of the invention are to provide an item drying device with the foregoing objects and advantages. Drying devices which are mounted on finned radiators are known in the art. Examples of such devices are those of the following U.S. Pat. Nos.:

| U.S. Pat. No. | Date | Inventor(s) |
|---|---|---|
| 2,087,757 | July 20, 1937 | Foss |
| 2,151,510 | March 21, 1939 | Gorfein |
| 3,833,127 | September 3, 1974 | Schoen et al. |
| 4,637,517 | January 20, 1987 | Barbosa et al. |

Also known in the prior art are boot racks with drip trays, as typified by Collins et al. U.S. Pat. No. 3,762,573 which issued Oct. 2, 1973.

Petre U.S. Pat. No. 4,530,168 which issued July 23, 1985 shows a combination boot carrier and drying device which is mounted on a wall bracket above but completely independent of a baseboard heater.

The aforementioned items of prior art do not teach or suggest the invention disclosed herein, either in structure or in the manner of functioning.

SUMMARY OF THE INVENTION

The invention presents an item drying device for use with a baseboard heater which is installed in a baseboard at the edge of a floor. The inventive device has an upper member, which may be of heat resistant plastic or metal. The upper member has an open rack portion on which items may be placed for drying and is provided with heater engaging means or portion for interlocking engagement with the heater. The device also has a substructure with a plurality of legs spaced from the heater engaging portion and from each other for supporting the upper member while engaging the floor. The legs are of adjustable length so that the rack portion can be set substantially horizontal, whatever the height of the top of the heater above the floor may be. The device also has a drip tray and means releasably holds the drip tray beneath the rack portion. The upper member further has a downwardly sloping closed portion between the rack portion and the heater engaging means for directing hot air from the heater to the rack portion. As disclosed, the rack portion and the closed portion are provided by a single piece of material.

The manner in which the invention achieves the foregoing objects and advantages will appear hereinafter.

DESCRIPTION OF THE INVENTION

Figure 1:
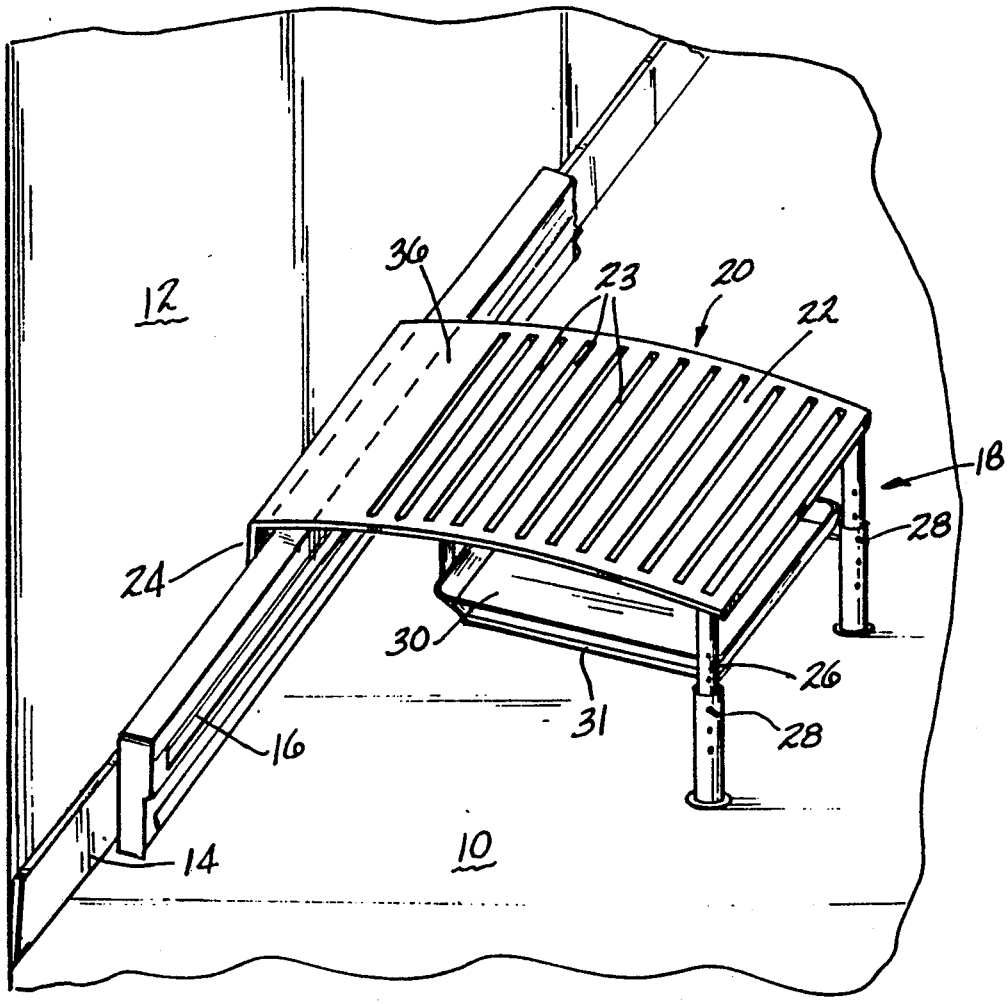
FIG. 1 is a somewhat schematic perspective view of an item drying device embodying the invention, the device being shown engaging a baseboard heater which is installed in a baseboard at the juncture of a floor and a wall.

FIG. 1 shows fragmentarily a floor 10 intersecting a wall 12, with a baseboard 14 at the intersection. Baseboard 14 is interrupted by a baseboard heater 16.

The drawing also shows an item drying device 18 for use with heater 16. Device 18 comprises an upper member 20 having a rack portion 22 on which items such as gloves, shoes, boots and other articles of clothing (not shown) may be placed for drying. Portion 22 has elongated apertures 23 therethrough, through which hot air can pass. Device 18 further has heater engaging means in the form of a heater engaging portion 24 which is shown in releasable interlocking engagement with heater 16. Heater engaging portion 24 is a downwardly turned flange which slips behind heater 16 to anchor device 18 to heater 16 in desired relationship thereto.

Device 18 also has a substructure including a plurality (two as shown) of legs 26 spaced from heater engaging portion 24 and from each other. Legs 26 support upper member 20 while engaging floor 10. As indicated at 28, legs 26 are of adjustable length so that the user can adjust the length of legs 26 so that rack portion 22 is substantially horizontal regardless of the height of the top of heater 16 above floor 10, there being quite a variation of such height.

Device 18 also is provided with a drip tray 30 and means for holding drip tray 30 beneath rack portion 22. As shown in FIG. 1, the drip tray holding means is provided by arms 31 which project from legs 26 beneath rack portion 22.

Upper member 20, which may advantageously be made of heat resistant plastic or metal, also has a downwardly sloping closed portion 36 between and joining rack portion 22 and heater engaging portion 24 for directing hot, drying air from heater 16 to rack portion 22 and through apertures 23 therethrough to dry items thereon. Rack portion 22, heater engaging portion 24 and closed portion 36 may be and as shown are provided by a single piece of material.

Figure 2:
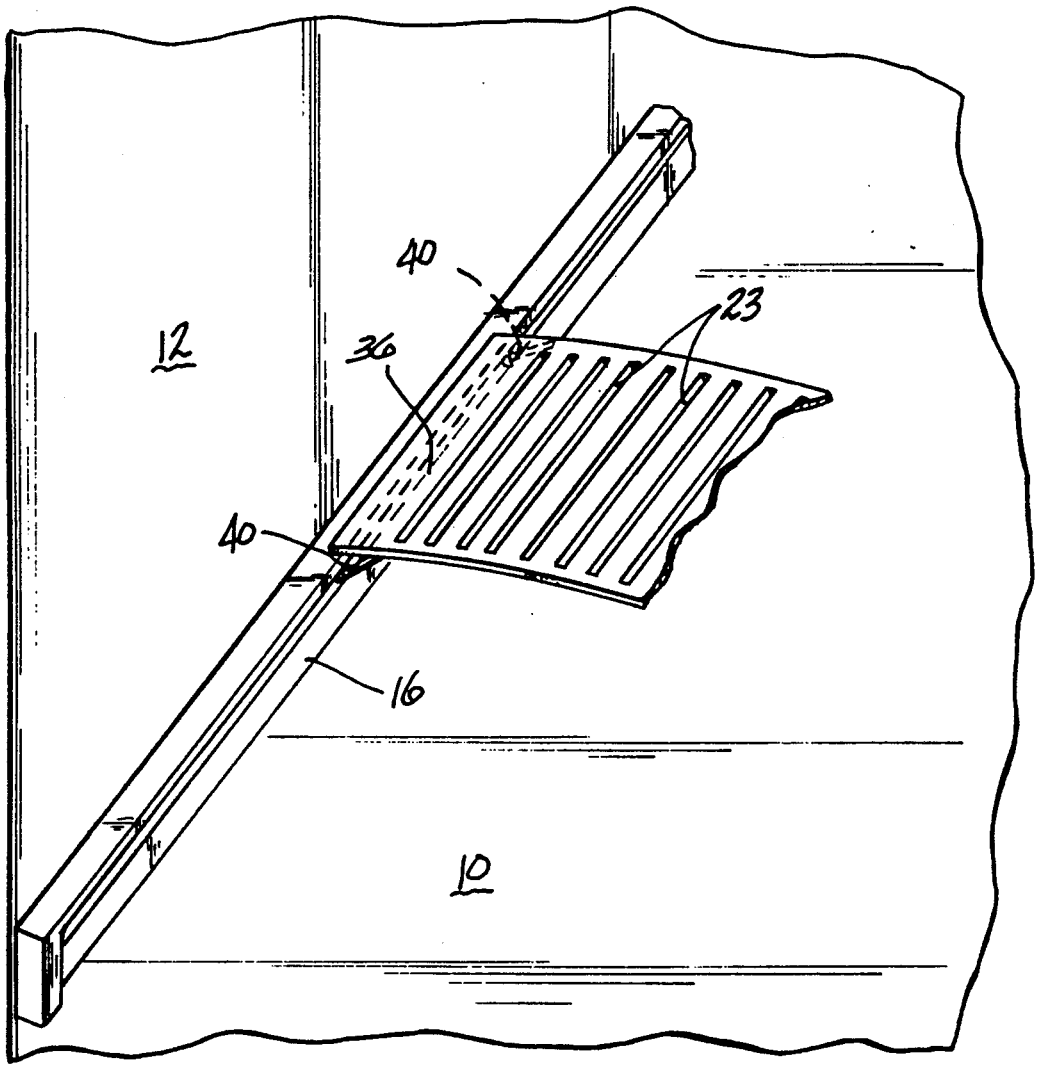
FIG. 2 is a fragmentary perspective view showing a first modification of the heater engaging means of the inventive device.

FIG. 2 shows a first modified heater engaging means. The heater engaging means of FIG. 2 is provided by a pair of spaced hooks 40 on the underside of downwardly sloping closed portion 36. Hooks 40 are resiliently biased upwardly and lock into the fold on the middle horizontal fin of heater 16. In this instance, portion 36 terminates shortly beyond hooks 40, at a location spaced from wall 12 to allow room for unlocking hooks 40 from heater 16.

Figure 3:
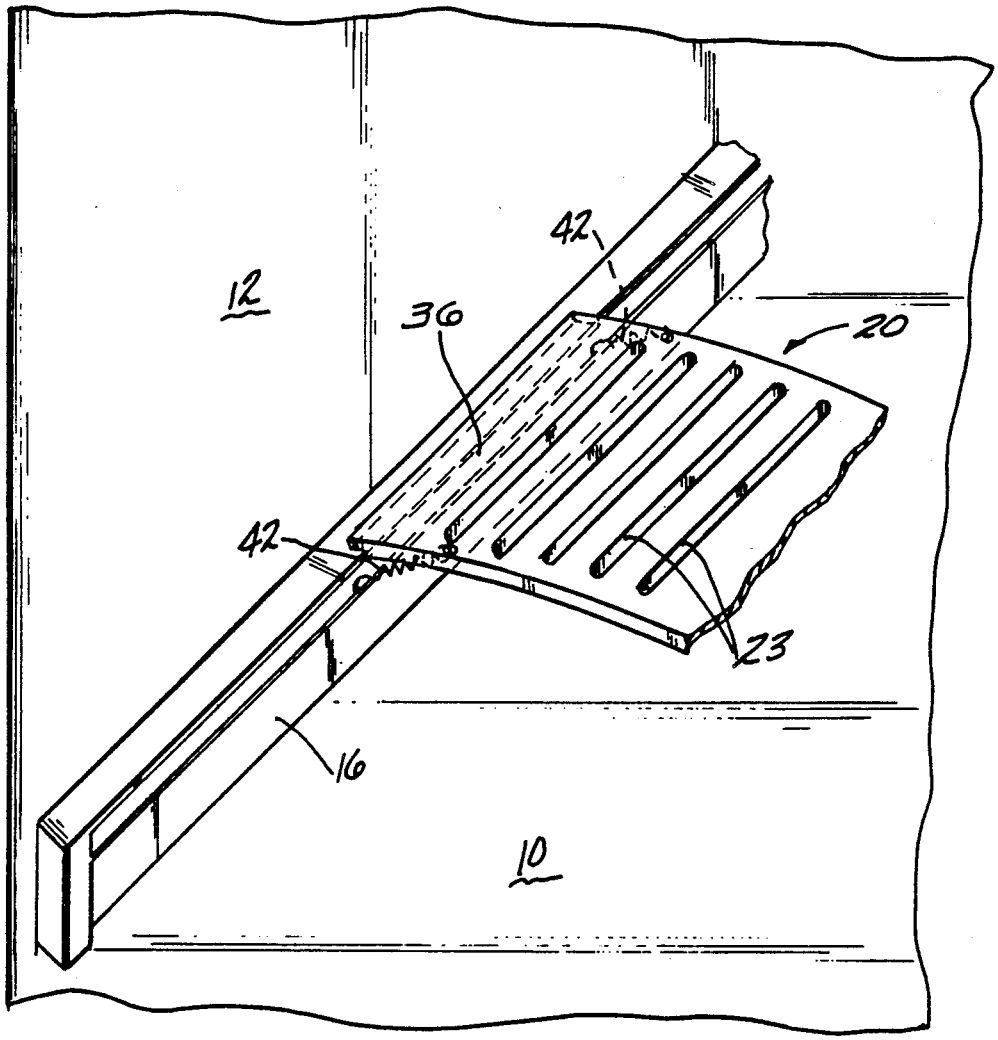
FIG. 3 is a view similar to FIG. 2 but showing a second modification of the heater engaging means.

FIG. 3 shows a second modified heater engaging means. The heater engaging means of FIG. 3 is provided by a pair of spaced coil springs 42. Each spring 42 has an upper end secured to upper member 20 and a lower end with a hook for releasably locking into the fold on the middle fin of heater 16, springs 42 being under tension when so installed.

It is evident that the invention attains the stated objects and advantages and others.

The disclosed details are exemplary only and are not to be taken as limitations on the invention except as those details may be included in appended claims.

What is claimed is:

1. An item drying device for use with a baseboard heater, said device comprising an upper member having a rack portion on which items may be placed for drying and heater engaging means for interlocking engagement with the heater, said rack portion having apertures therethrough through which hot air can pass and a substructure having a plurality of straight legs spaced from said heater engaging means and from each other for supporting said upper member while engaging a floor, said legs being substantially perpendicular to said upper member, and being of adjustable length so that said rack portion can be set in a substantially horizontal position regardless of the height of the top of the heater above the floor.

2. An item drying device for use with a baseboard heater, said device comprising an upper member having a rack portion on which items may be placed for drying and heater engaging means for interlocking engagement with the heater, said rack portion having apertures therethrough through which hot air can pass said a substructure having a plurality of legs spaced from said heater engaging means and from each other for supporting said upper member while engaging a floor, said legs being of adjustable length so that said rack portion can be set in a substantially horizontal position regardless of the height of the top of the heater above the floor, further comprising a drip tray and wherein said upper member has means for releasably holding said drip tray beneath said rack portion.

3. A drying device according to claim 2 wherein said means for holding said drip tray includes arms projecting beneath said rack portion from said legs.

4. An item drying device for use with a baseboard heater, said device comprising an upper member having a rack portion on which items may be placed for drying and heater engaging means for interlocking engagement with the heater, said rack portion having apertures therethrough through which hot air can pass and a substructure having a plurality of legs spaced from said heater engaging means and from each other for supporting said upper member while engaging a floor, said legs being of adjustable length so that said rack portion can be set in a substantially horizontal position regardless of the height of the top of the heater above the floor, wherein said upper member further has a downwardly sloping closed portion between and joining said rack portion and said heater engaging portion for directing hot air form the heater to said rack portion.

5. A drying device according to claim 4 wherein said rack portion and said closed portion are provided by a single piece of material.

6. A drying device according to claim 1 wherein said upper member is made of heat resistant plastic or metal.

7. A drying device according to claim 1 wherein said heater engaging means is a downwardly turned flange adapted to slip behind the heater.

8. An item drying device for use with a baseboard heater, said device comprising an upper member having a rack portion on which items may be placed for drying and heater engaging means for interlocking engagement with the heater, said rack portion having apertures therethrough through which hot air can pass and a substructure having a plurality of legs spaced from said heater engaging means and from each other for supporting said upper member while engaging a floor, said legs being of adjustable length so that said rack portion can be set in a substantially horizontal position regardless of the height of the top of the heater above the floor, wherein said upper member further has a downwardly sloping closed portion integral with said rack portion.

9. A drying device according to claim 8 wherein said heater engaging means include a pair of spaced hooks beneath said downwardly sloping portion and releasably engageable with the heater.

10. A drying device according to claim 8 wherein said heater engaging means include a pair of spaced coil springs each having an upper end engaging said upper member and a lower end for engaging the heater with said springs under tension.

* * * * *